US005272881A

United States Patent [19]

Lee

[11] Patent Number: 5,272,881

[45] Date of Patent: Dec. 28, 1993

[54] LIQUID CRYOGEN DISPENSING APPARATUS AND METHOD

[75] Inventor: Ron C. Lee, Bloomsbury, N.J.

[73] Assignee: The BOC Group, Inc., New Providence, N.J.

[21] Appl. No.: 936,429

[22] Filed: Aug. 27, 1992

[51] Int. Cl.[5] ..... F17C 7/02

[52] U.S. Cl. ..... 62/50.4; 62/49.2; 62/50.1; 222/146.2

[58] Field of Search ..... 62/49.2, 50.1, 50.2, 62/50.4; 220/901; 239/132, 133, 136; 222/146.1-; 137/341

[56] References Cited

U.S. PATENT DOCUMENTS

| | | | |
|---|---|---|---|
| 4,136,721 | 1/1979 | Holmqvist | 222/146.2 X |
| 4,586,343 | 5/1986 | Buschkens et al. | 62/50.1 |
| 4,608,831 | 9/1986 | Gustafson | 222/146.5 X |
| 4,715,187 | 12/1987 | Stearns | 62/50.1 |
| 4,854,128 | 8/1989 | Zeamer | 62/50.1 |
| 5,018,358 | 5/1991 | Lee et al. | 62/50.1 X |
| 5,060,481 | 10/1991 | Bartlett et al. | 137/341 X |
| 5,169,031 | 12/1992 | Miller | 222/146.5 |

*Primary Examiner*—David M. Mitchell
*Assistant Examiner*—Kenneth DeRosa
*Attorney, Agent, or Firm*—David M. Rosenblum; Larry R. Cassett

[57] ABSTRACT

A liquid cryogen is supplied, preferably by means of a reservoir, to a dispensing tube so that the liquid cryogen tends to flow from the dispensing tube. A heating coil wrapped around the dispensing tube heats the dispensing tube so that the liquid cryogen undergoes nucleate boiling within the dispensing tube to form a vapor block, and thereby at least impede the liquid cryogen from flowing from the dispensing tube. Flow is reestablished within the dispensing tube by terminating the heating of the dispensing tube, e.g. by turning off electrical power supplied to the heating coil. The heating of the dispensing tube can be sufficient to stop the flow of liquid cryogen. Additionally, the dispensing tube can be cyclically heated by a timing circuit connected to the heating coil. Such cyclical heating is used to throttle the flow of the liquid cryogen from the dispensing tube.

9 Claims, 2 Drawing Sheets

LIQUID CRYOGEN DISPENSING APPARATUS AND METHOD

BACKGROUND OF THE INVENTION

The present invention relates to an apparatus and method for dispensing a liquid cryogen. More particularly, the present invention relates to such an apparatus and method in which the liquid cryogen is dispensed through a dispensing tube and the flow of liquid cryogen within the dispensing tube is inhibited or stopped by heating the dispensing tube to an extent that the liquid cryogen undergoes nucleate boiling within the dispensing tube.

Liquid cryogen is dispensed in a wide variety of industrial processes. For example, containers such as aluminum cans are pressurized by dispensing discrete amounts of nitrogen into the containers prior to their being sealed. A common approach for accomplishing such dispensing is to simply allow a stream of liquid nitrogen to fall into the cans (before sealing) as the cans are propelled along a conveyor. The problem with such dispensing is that liquid nitrogen is wasted and in order to ensure measured amounts of liquid nitrogen are deposited in each of the cans, the food processing line must travel at a constant rate.

An alternative approach for dispensing a liquid cryogen is to accurately meter the liquid cryogen. An example of a device designed to carry out such an approach is disclosed in European Patent Application 0 331 287 published Sep. 6, 1989. The device disclosed in this patent consists of a reservoir having an electrically heated dispensing tube connected to the bottom of the reservoir. Liquid cryogen contained within the reservoir is metered by an electrically controlled solenoid valve which, when activated, closes off the dispensing tube. The dispensing tube is electrically heated so that liquid cryogen within the dispensing tube undergoes film boiling. The film boiled liquid cryogen within the dispensing tube acts to lubricate slugs of liquid cryogen that are dispensed from the dispensing tube when the solenoid valve is raised.

As will be discussed, the Present invention provides an apparatus and method for dispensing cryogen that does not rely on conventional solenoid valves and the like to accomplish the dispensing of the liquid cryogen. Additionally, the dispensing apparatus and method of the present invention provide a flexibility in dispensing that is not present in the prior art.

SUMMARY OF THE INVENTION

The present invention provides a liquid cryogen dispensing apparatus comprising a dispensing passageway means, a supply means and an actuable heating means. The dispensing passageway means provide a dispensing passageway and the supply means supply the liquid cryogen to the dispensing passageway means so that the liquid cryogen tends to flow through the dispensing passageway. The actuable heating means heat the dispensing tube when actuated. The heating causes the liquid cryogen to undergo nucleate boiling when flowing through the dispensing passageway. The dispensing passageway is configured such that the nucleate boiling of the liquid cryogen at least inhibits the flow of the liquid cryogen through the dispensing passageway. It should be noted that nucleate boiling is characterised by the evolution of discrete gas bubbles within the liquid cryogen. This is to be compared with film boiling, a higher temperature phenomena in which the surface of an article becomes covered with a film of vapor. Moreover, the configuration (that is the diameter for dispensing passageway means formed by a tube) of the dispensing passageway causes the nucleate boiling to at least inhibit the flow of the liquid cryogen without the use of mechanical valves and the like.

In another aspect, the present invention provides a method for dispensing liquid cryogen. In accordance with such method, the liquid cryogen is supplied to a dispensing passageway so that the liquid cryogen tends to flow through the dispensing passageway. The dispensing passageway is contained within dispensing means for providing the dispensing passageway and is configured such that nucleate boiling of the liquid cryogen within the dispensing passageway will at least inhibit the flow of the liquid cryogen through the dispensing passageway. The flow of the liquid cryogen through the dispensing passageway is at least inhibited by heating the dispensing passageway means so that the liquid cryogen undergoes nucleate boiling. The flow of the liquid cryogen through the dispensing passageway is reestablished by terminating the heating of the dispensing passageway means.

The present invention can be used to deposit discrete amounts of liquid cryogen into, for instance, food containers moving along a food processing line. Additionally, as will be discussed, the present invention can be used to throttle the flow rate of liquid cryogen being dispensed from the dispensing tube. This potential mode of Applicant's invention can be advantageously used to compensate for variations in the speed of a canning line.

BRIEF DESCRIPTION OF THE DRAWINGS

While the specification concludes with claims distinctly pointing out the subject matter that Applicant regards as his invention, it is believed that the invention will be better understood when taken in conjunction with the accompanying drawings in which:

DETAILED DESCRIPTION

Figure 1:
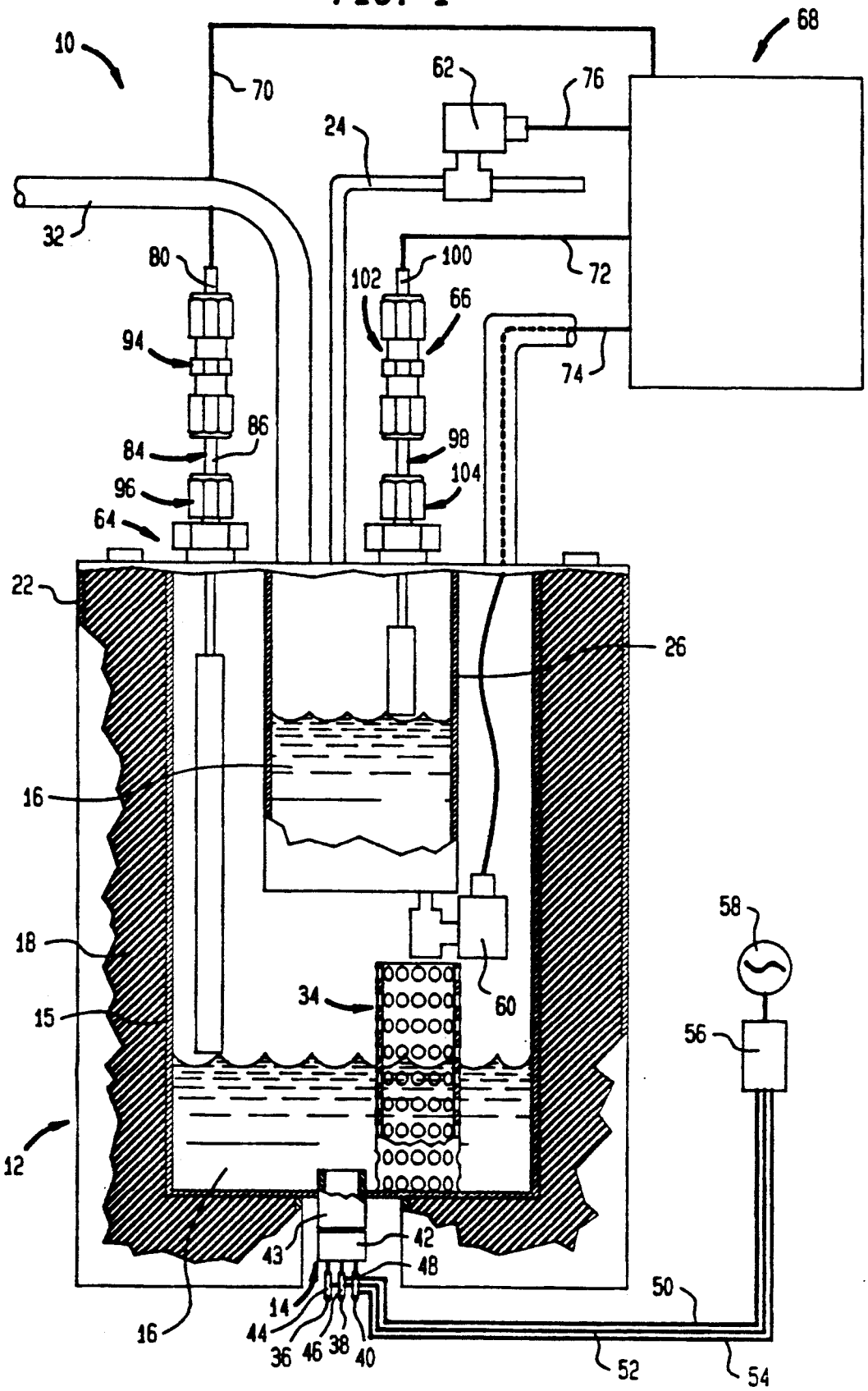
FIG. 1 is an elevational view of an apparatus in accordance with the present invention.

With reference to FIG. 1, a liquid cryogen dispenser 10 in accordance with the present invention is illustrated. Liquid cryogen dispenser 10 comprises a reservoir 12 of cylindrical configuration and a dispensing tube assembly 14. Reservoir 12 includes a container 15 to contain a liquid cryogen 16 to be dispensed from dispensing tube assembly 14. The liquid cryogen 16 in the illustrated embodiment is liquid nitrogen, but as would be well understood by those skilled in the art, the present invention has equal applicability to other cryogenic liquids. Container 15 is a cylinder, about 30 cm. in diameter and is covered by approximately 7.62 cm. of insulating foam 18 which is contained within an outer protective wall 22.

Liquid cryogen 16 is initially supplied from a source of liquid nitrogen through a supply tube 24. In order to prevent liquid cryogen 16 from flashing within container 15 and thus changing the pressure within container 15, liquid cryogen 16 first enters a phase separation tank 26 from which liquid cryogen 16 subsequently flows into container 15. A vent 32 is provided for venting phase separation tank 26, and a baffle chamber 34 is positioned to receive liquid cryogen 16 flowing from phase separation tank 26. Baffle chamber 34 is a perforated tube and acts to prevent liquid cryogen 16 from disturbing the liquid surface within container 15.

Figure 2:
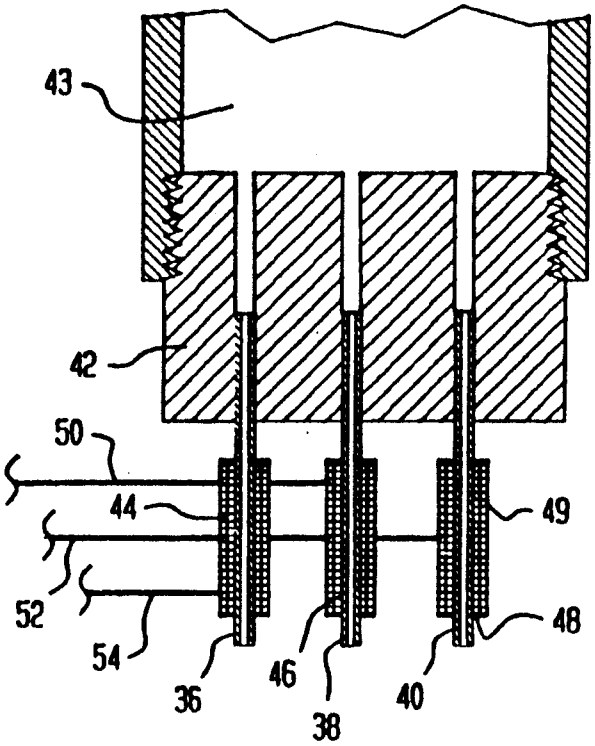
FIG. 2 is a fragmentary view of FIG. 1.

With reference now to FIG. 2, dispensing assembly 14 can be seen to comprise 3 dispensing tubes 36, 38 and 40 connected to a plug 42. Plug 42 threadably engages an internally threaded pipe 43 connected to the bottom of container 15 so that liquid cryogen 16 tends to flow out dispensing tubes 36, 38 and 40. It should be pointed here that a possible embodiment of the preferred invention can be constructed with only a single dispensing tube. Multiple dispensing tubes, such as the three illustrated, can advantageously be used to increase the amount of cryogen to be dispensed and/or provide a greater flexibility in the amount of liquid cryogen to be dispensed at any one particular time. For instance, one or a multitude of dispensing tubes can be used to dispense the liquid cryogen.

As illustrated, each of the dispensing tubes 36, 38 and 40 are formed by a stainless steel tube, approximately 2.54 cm long, having an outer diameter of about 1.65 mm and an inner diameter of approximately 1.35 mm.

Each of the dispensing tubes, 36, 38 and 40 are covered with single wound coils 44, 46, and 48 of 32 gauge Nichrome heater wire having a total length of approximately 25.4 cm. per heater coil. Each of the heater coils is covered by a layer 49 of high thermal conductive epoxy, such as OMEGABOND 101, manufactured by Omega Engeering, Inc. of Stamford, Conn. Each of the heater coils (44, 46 and 48) have electrical leads 50, 52, and 54 connected to a timing circuit 56 which is in turn connected to a variable output power supply 58. When an electrical current is supplied from power supply 58 through timing circuit 56 to electrical leads 50, 52, 54, coils 44, 46 and 48 are energized to heat dispensing tubes 36, 38, and 40.

Timing circuit 56 and power supply 58 .can be separate components or an integrated component which are very well known in the art. Preferably, timing circuit 56 is of the type that allows current to be applied to the heater coils 44, 46, and 48 so that the current is applied for preselected on time intervals and is turned off for preselected off time intervals that can be made to cycle back and forth continuously. As will be discussed, during the on time interval, when power is supplied to heater coils 44, 46, and 48, the flow of liquid cryogen 16 through dispensing tubes 36, 36, 40 will cease. Practically, the off time intervals can be set to deliver predetermined amounts of cryogen to food containers. The on time intervals can be set to ensure that a food container is directly under a dispensing tube or tubes during dispensing. As will also be discussed the dispensing tubes can be heated so as to throttle the flow of liquid cryogen 16.

Power supply 58 is set to supply a sufficient amount of electrical power to any one of heater coils 44, 46, and 48 so as to cause liquid cryogen 16 to undergo nucleate boiling within dispensing tubes 36, 38, and 40. Such nucleate boiling will create a vapor block within dispensing tubes 36, 38, and 40 that will, together with atmospheric pressure, counteract the hydrostatic pressure of liquid cryogen 16 to stop the flow of liquid cryogen 16 through dispensing tubes 36, 38, and 40. As can be appreciated, if the height of liquid cryogen 16 is great enough, then the flow of liquid cryogen 16 will only be inhibited, that is slowed down. Furthermore, if the inside diameter of a dispensing tube is too large, the nucleate boiling of liquid cryogen 16 will only serve to inhibit the flow. It should be pointed out that such flow inhibition can be an advantageous mode of operation for the present invention for flow throttling purposes. At an opposite extreme, if such inside diameter is made even larger, nucleate boiling of liquid cryogen 16 will not effect the flow. A further point is that the heat capacity of a dispensing tube, such as dispensing tubes 36, 38, and 40 is important because it will effect the speed of response.

In order to set apparatus 10 to stop the flow of liquid cryogen 16, variable power supply 58 is set to deliver a sufficient power to stop the flow. Thereafter, the power level is decreased to the minimum power required to stop the flow. If too much power is supplied, then liquid cryogen 16 will undergo film boiling within a dispensing tube (36, 38, or 40) and the liquid cryogen flow will be reestablished.

Another way to accomplish flow throttling is to appropriately set the on and off times of timing circuit 56. Assuming a cyclical operation between the on and off times of timing circuit 56, an increase in the off time will increase the flow rate of liquid cryogen 16 and vice-versa. This is a particularly advantageous mode of operation in that it allows liquid cryogen dispensing apparatus 10 to be set to continuously dispense liquid cryogen such as nitrogen into a moving line, of for instance, food cans at an average flow rate calculated to deposit a specific amount of nitrogen into each food can. If the speed of the production line changes, then the on and off times can be changed to adjust the flow rate.

As can be appreciated, the level of liquid cryogen 16 contained within container 15 must be held constant. This is accomplished in the present invention by provision of an electrically controlled cut-off valve 60 from which liquid cryogen 16 is delivered from the bottom of phase separation tank 26 to container 15. When the level of liquid cryogen 16 within container 15 drops below a predetermined point, cut-off valve opens to replenish container 15. In order to meet the demand of container 15, a constant level of liquid cryogen 16 must be maintained within phase separation tank 26. To this end, a cut-off valve 62 is connected to supply line 24. Cut off valve 62 opens to resupply phase separation tank 26 with liquid cryogen 16 when liquid cryogen 16 falls below a predetermined level within phase separation tank 26.

The levels of liquid cryogen 16 are sensed within container 15 by means of a level detector 64 and within phase separation tank 26 by means of a level detector 66. When liquid cryogen 16 falls below predetermined levels, that is the bottom of level detectors 64 and 66, a controller 68, responsive to electrical signals generated by level detectors 64 and 66, activates cut-off valves 64 and 66 to open to allow either phase separation tank 26 or container 15 to be replenished with liquid cryogen 16. As illustrated, level detector 64 is connected to controller 68 by lead wires 70, level detector 66 is connected to controller 68 by lead wires 72, and cut-off valves 60 and 62 are connected to controller 68 by lead wires 74 and 76.

There exist a wide variety of readily obtainable level detectors that can be used in connection with the present invention. In any event, the design of level detectors 64 and 66 will now be discussed. Level detectors 64 and 66 are described in a patent application, Ser. No.

07/790/740, filed Nov. 8, 1991 by the inventor herein and assigned to the assignee of this application, The BOC Group, Inc.

Figure 3:
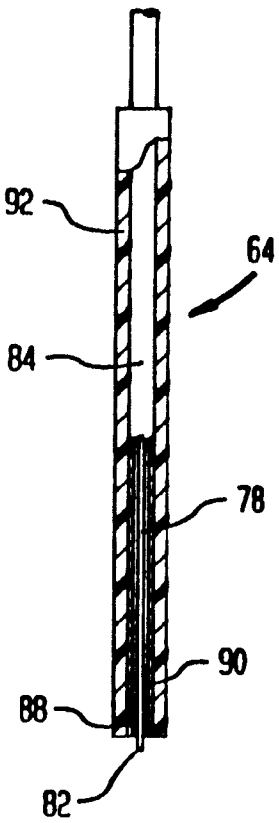
FIG. 3 is an enlarged fragmentary view of a level detector used in the apparatus of FIG. 1 with portions thereof broken away.

With reference now to FIG. 3., level detector 64 utilizes a 0.508 mm. diameter stainless steel shielded type T thermocouple probe 78, approximately 45.72 cm. long, which can be obtained from Omega Engineering, Inc. of Stamford, Conn. Thermocouple probe 78 has a proximal end 80 from which electrical leads 70 extend. Although not illustrated, electrical leads 70 are two insulated electrical conductors that function to transmit a temperature signal generated by a thermocouple contained within a distal end 82 of thermocouple probe 78.

Thermocouple probe 78 senses a sensor temperature that implies the convective heat transfer coefficient of its surroundings. This is accomplished by providing a thermal conductor 84. Thermal conductor 84 at opposite ends 86 and 88 is in good thermal contact with the thermocouple contained within distal end 82 of the thermocouple probe 78 and is exposed to the ambient, respectively. The good thermal contact between end 88 of thermal conductor 84 and distal end 82 of thermocouple probe 78 is preferably effectuated through the use of a bead 90 of a high thermal conductivity epoxy such as OMEGABOND 101 manufactured by Omega Engineering, Inc. of Stamford, Conn. Thermal conductor 84 conducts the heat to the thermocouple contained within distal end 82 of thermocouple probe 78.

Thermal conductor 84 is formed of 3.175 mm. copper tubing, approximately 45.72 cm. in length. Thermal conductor 84 is insulated along 30.48 cm. of its length by 6.35 mm. insulation 92 formed by a tube of insulative material such as polytetrafluoroethylene. The insulation insures that heat will not be dissipated along the length of thermal conductor 84. Approximately, 3.175 mm. of distal end 82 of thermocouple probe 78 is exposed. The small degree to which distal end 82 is exposed assures a minimum response time when the thermocouple junction transists from liquid to gas or vice-versa.

Due to the heat transfer through thermal conductor 84 and the consistency of such heat transfer, the temperature of distal end 82 ($T_{tip}$)and therefore, the temperature signal generated within electrical leads 70 will be given by the following relationship:

$$T_{tip} = T_{cryogen} + \frac{Q}{h_c A}$$

The sensed temperature will therefore equal a sum of the cryogen temperature given by $T_{cryogen}$ plus a constant equal to the essentially constant heat transferred to the distal end 20 (Q) divided by area and $h_c$ which equals the convective heat transfer coefficient.

The convective heat transfer coefficient is greater in the cryogenic liquid than in the cryogenic vapor overlying the liquid. Hence, when distal end 82 of thermocouple probe 78 is submerged within the cryogen, a lower temperature will be sensed than when distal end 82 of cryogenic probe 78 is clear of the liquid cryogen and is within the cryogenic vapor. Controller 68 can be any one of a number of well known control circuits or digital controllers connected to a power source responsive to the change in the temperature signals to in turn control the opening and closing of cut-off valves 60 and 62.

Thermal conductor 84 is connected to proximal end 80 of thermocouple probe 78 by opposed compression fittings of threaded junction 94. Thermal conductor 84 is in turn connected to reservior 12 by a compression fitting of threaded member 96. Level detector 66 is identical in design to level detector 64 except that it is provided with a thermal conductor 98, approximately 15.24 cm. long, insulated along approximately 7.62 cm. of its length, and a thermocouple probe, of which proximal end 100 is visible in FIG. 1, approximately 15.24 cm. in length. Opposed compression fittings of threaded junction 102 serve to connect such thermocouple probable to thermal conductor 98; and thermal conductor 98 is in turn connected to the top of reservior 12 by a compression fitting of threaded member 104.

While a preferred embodiment has been described in detail, it will be obvious to those skilled in the art that numerous additions, changes and/or omissions can be made without departing from the spirit and scope of the invention.

I claim:

1. A liquid cryogen dispensing apparatus comprising:

dispensing passageway means for providing a dispensing passageway;

supply means for supplying the liquid cryogen to the dispensing passageway means so that the liquid cryogen tends to flow through the dispensing passageway; and actuatable heating means for heating the dispensing passageway means so that when actuated, the liquid cryogen undergoes nucleate boiling when flowing through the dispensing passageway means;

the dispensing passageway configured such that the nucleate boiling of the liquid cryogen at least inhibits the flow of the liquid cryogen through the dispensing passageway means.

2. The liquid cryogen dispensing apparatus of claim 1, wherein the dispensing means comprises a tube having an internal circular, transverse cross section forming the dispensing passageway and sized such that the nucleate boiling of the liquid cryogen at least inhibits the flow thereof.

3. The liquid cryogen dispensing apparatus of claim 2, wherein the heating means includes a heating coil wrapped around the dispensing tube, the heating coil adapted to be connected to an electrical power source such that the heating coil heats the dispensing tube.

4. The liquid cryogen dispensing apparatus of claim 2, wherein:

the supply means comprises as a reservoir containing the liquid cryogen; and the dispensing tube is connected to the reservoir at a location thereof such that hydrostatic pressure of the liquid cryogen contained within the reservoir drives the liquid cryogen through the dispensing tube.

5. The liquid cryogen dispensing apparatus of claim 4, wherein the supply means also comprises level means for maintaining the liquid cryogen at a constant level within the reservoir.

6. The liquid cryogen dispensing apparatus of claim 4, wherein the level means comprises:

a phase separation tank connected to a source of the liquid cryogen to prevent the liquid cryogen from flashing within the reservoir, the phase separation tank having a bottom opening from which the liquid cryogen flows into the reservoir; and a baffle chamber located below the bottom opening of the phase separation tank for preventing the liquid cryogen from splashing into the reservoir;

first and second electrical controlled cut-off valves connected to the bottom of the phase separation tank, in communication with the bottom opening thereof, and within the supply line, respectively, for cutting off the flow of the liquid cryogen to the phase separation tank and for cutting off the flow of the liquid cryogen from the phase separation tank to the reservoir;

first and second level detector means having sensors located at predetermined levels within the phase separation tank and the reservoir and having sensors for generating electrical signals when the liquid cryogen falls below the pre-determined levels; and control means responsive to the electrical signals and connected to the first and second cut-off valves for selectively opening the first and second cut-off valves so that the liquid cryogen remains at the predetermined levels.

7. A method of dispensing a liquid cryogen comprising:

supplying the liquid cryogen to a dispensing passageway so that the liquid cryogen tends to flow through the dispensing passageway;

the dispensing passageway, contained within dispensing means for providing the dispensing passageway and configured such that nucleate boiling of the liquid cryogen within the dispensing passageway will at least inhibit the flow of the liquid cryogen through the dispensing passageway;

at least inhibiting the flow of the liquid cryogen through the dispensing passageway by heating the dispensing passageway means so that the liquid cryogen undergoes the nucleate boiling; and reestablishing the flow of the liquid cryogen through the dispensing passageway by terminating the heating of the dispensing passageway means.

8. The method of claim 7 wherein the heating of the dispensing passageway means is sufficient to stop the flow of liquid cryogen within the dispensing passageway.

9. The liquid cryogen dispensing apparatus of claim 6 wherein the dispensing Passageway means is heated for the duration of an on time interval and the heating of the dispensing passageway means is terminated for the duration of an off time interval in a repeating cyclical manner such that adjusting the durations of the on and off time intervals will throttle the flow of the liquid cryogen through the dispensing tube.

* * * * *